US005880669A

United States Patent [19]

Matsumoto et al.

[11] Patent Number: 5,880,669

[45] Date of Patent: Mar. 9, 1999

[54] VARIABLE RESISTANCE DEVICE

[75] Inventors: Akikazu Matsumoto, Toyota; Kiyotaka Nakai, Chita; Wataru Kuwayama, Nagoya; Kiyohiro Fukaya, Takahama; Yukihisa Oda, Chiryu, all of Japan

[73] Assignee: Aisin Seiki Kabushiki Kaisha, Kariya, Japan

[21] Appl. No.: 807,684

[22] Filed: Feb. 28, 1997

[30] Foreign Application Priority Data

Feb. 29, 1996 [JP] Japan ..... 8-042855

[51] Int. Cl.[6] ..... H01C 10/30

[52] U.S. Cl. ..... 338/160; 338/184

[58] Field of Search ..... 338/19, 20, 22, 338/70, 77, 80, 160, 163, 184, 192, 195, 199, 202, 226, 118, 102, 171, 174, 176, 194

[56] References Cited

U.S. PATENT DOCUMENTS

| | | | |
|---|---|---|---|
| 4,314,229 | 2/1982 | Kawasaki | 338/160 |
| 4,355,293 | 10/1982 | Driscoll | 338/184 |
| 4,430,634 | 2/1984 | Hufford et al. | 338/164 |
| 4,642,602 | 2/1987 | Maisch et al. | 338/162 |
| 4,715,220 | 12/1987 | Eitoku et al. | 338/73 |
| 4,928,082 | 5/1990 | Yagi et al. | 338/174 |
| 4,933,661 | 6/1990 | Oda et al. | 338/174 |
| 4,994,782 | 2/1991 | Watanabe et al. | 338/160 |
| 5,095,298 | 3/1992 | Chapman et al. | 338/162 |
| 5,141,982 | 8/1992 | Oku et al. | 524/432 |

FOREIGN PATENT DOCUMENTS

| | | |
|---|---|---|
| 1-95602 | 6/1989 | Japan . |
| 7-326407 | 12/1995 | Japan . |

*Primary Examiner*—Teresa Walberg
*Assistant Examiner*—Jeffrey Pwu
*Attorney, Agent, or Firm*—Burns, Doane, Swecker & Mathis, LLP

[57] ABSTRACT

A compact-size variable resistance device has a terminal for electrical connection to an external device, a resistor that slidingly contacts with a brush, and connecting parts formed of an electro-conductive resin containing a thermoplastic resin. The electro-conductive resin connecting parts readily make reliable electrical interconnection of the terminal and the resistor when the connecting parts are joined by, for example, ultrasonic bonding.

14 Claims, 2 Drawing Sheets

VARIABLE RESISTANCE DEVICE

FIELD OF THE INVENTION

The present invention relates to a variable resistance device having a resistor that is formed on a substrate and, also, to a device that detects position, such as a throttle sensor, a steering sensor, a body height sensor or the like for a vehicle.

BACKGROUND OF THE INVENTION

A conventional variable resistance device is disclosed in Japanese Utility Model Laid-Open No. Hei 1-95602. This laid-open application describes a sensor for detecting the opening of a throttle valve. A portion of the sensor is shown in FIG. 4. In the sensor, the connection between a throttle valve opening detecting portion provided on a substrate 3 supported by a substrate support 8 and a contact terminal 31 formed together with a housing 1 is achieved by a terminal portion 26 and a tongue piece conductor 36. The terminal portion 26 is electrically connected to the throttle valve opening detecting portion, and the tongue piece conductor 36 has a springy elasticity that presses in a direction substantially perpendicular to a surface of the terminal portion 26 so as to electrically connect the terminal portion 26 to the contact terminal 31 thus enabling electrical connection of the terminal portion 26 to an external device. The housing 1 is connected with a cover 9 at a mount portion 1*a* provided in the housing 1.

However, since the electrical connection of the terminal portion 26 on the substrate 3 to the contact terminal 31 is made by pressing the tongue piece conductor 36 against the terminal portion 26 in this conventional variable resistance device, there exists the possibility that an insulating layer will be formed in the contact junction between the tongue piece conductor 36 and the terminal portion 26 by oxidation or moisture, thereby causing problems with electrical conduction. In addition, a contact failure may be caused between the substrate 3 and the contact terminal 31 by vibrations or the like. Thus, the conventional device is considered inadequate in that it fails to ensure good electric conduction between the contact terminal 31 and the throttle valve opening detecting portion. If the terminal portion 26 and the contact terminal 31 are soldered to each other in an attempt to achieve reliable conduction, the production man hours will increase. Further, a space will be required between the substrate 3 and the housing 1 in order to fix the substrate 3 to the housing 1, thereby resulting in a construction that contradicts the size reduction demands associated with variable resistance devices.

SUMMARY OF THE INVENTION

Accordingly, a need exists for a variable resistance device that addresses the aforementioned problems.

According to one aspect of the present invention, there is provided a variable resistance device that includes a terminal for electrical connection to an external device, a resistor formed in a resin-made substrate for slidingly contacting a brush, and an electro-conductive resin member containing a thermoplastic resin for electrically interconnecting the terminal with the resistor.

In accordance with another aspect of the invention, a variable resistance device includes a housing, a thermoplastic resin substrate mounted on the housing, a resistor formed on the substrate, a brush positioned in the housing in sliding contact with the resistor, a terminal for electrical connection to an external device, and an electro-conductive resin member made of thermoplastic resin and electrically interconnecting the terminal and the resistor.

The variable resistance device of the present invention belongs to a type of resistance device which allows a brush to slide on the resistor and detects the voltage that varies depending on the position of the brush. Such resistance devices are typically employed in apparatus for detecting position corresponding to the detected voltage. Normally, as the volume resistivity of the resistor is increased, the change in the voltage detected corresponding to a displacement of the brush increases, thus enabling detection with increased precision on. However, since excessively great magnitudes of volume resistivity of the resistor impede current through the resistor to undesired extents, the volume resistivity of the resistor is normally limited within a range of $10^2$ to $10^4$ Ω•cm. If the volume resistivity of the resistor is within such a normal range, the incorporation of an electro-conductive resin member causes no problem with the performance of the variable resistance device. This explains why the electro-conductive resin member can be used to electrically connect the resistor to the terminal according to the present invention.

By employing the electro-conductive resin, the present invention increases the degree of freedom in interconnecting the terminal and the resistor during production of the variable resistance device. For example, the substrate and the electro-conductive resin member may be molded together by injection, so as to ensure sufficient electrical conduction between the terminal and the resistor without increasing the thickness of the substrate.

The electro-conductive resin member may contain a metal in addition to the thermoplastic resin, with the proportion composition of the electro-conductive resin being within such a range that injection molding of the electro-conductive resin is possible. This preferable but not essential limitation of the proportion composition of the electro-conductive resin increases the degree of freedom for the connection between the terminal and the resistor during production of the variable resistance device, so that the number of component parts required for the electric conduction between the resistor and the terminal can be reduced and the production man hours can also be reduced. Further, the electro-conductive resin member may be a material in which metallic fibers or fibers carrying metal on their surfaces are dispersed in the thermoplastic resin, so that conductivity is provided by contacts between the metal fibers. Examples of metallic fibers include copper fibers, copper alloy fibers, stainless steel fibers, aluminum fibers, nickel fibers. Examples of thermoplastic resin include polybutylene terephthalate, polyethylene terephthalate, polyphenylene sulfide, polyamide, liquid crystal polymer, polystyrene, polyether imide, polybenzimidazole, polyether-ether ketone, polyether sulfone.

The electro-conductive resin member may contain at least 80 vol. % of the thermoplastic resin and at most 20 vol. % of the metal. The volume resistivity of the electro-conductive resin member may be within a range of about $10^{-4}$ to 1.0 Ω•cm. This preferable but not essential limitation of the proportion composition, wherein the proportion of the thermoplastic resin by volume is relatively great, provides the variable resistance device with a sufficient conductivity and facilitates injection molding of the electro-conductive resin.

The volume resistivity of the resistor may be at least $10^3$ times the volume resistivity of the electro-conductive resin member. This preferable but not essential feature substantially eliminates the influence of the current through the electro-conductive resin member on detection of the resistance that varies as the brush moves in a sliding manner on the resistor.

The volume resistivity of the resistor may be within a range of $10^2$ to $10^4$ Ω•cm and the volume resistivity of the electro-conductive resin member may be within a range of $10^{-4}$ to 1.0 Ω•m. These ranges are preferable but not essential according to the invention. Since the relatively high set-range of the volume resistivity of the resistor considerably improves the detection precision of the variable resistance device, employment of an electro-conductive resin member having a volume resistivity of $10^{-4}$ to 1.0 Ω•cm has substantially no adverse effect on the position detection by the variable resistance device.

The electro-conductive resin member may comprise a first electro-conductive resin part that is formed together with the terminal and a second electro-conductive resin part that is formed on the substrate, with the first electro-conductive resin part and the second electro-conductive resin part being joined by ultrasonic bonding. Since the terminal and the resistor on the substrate are electrically interconnected by the ultrasonic-bonding of the first and second electro-conductive resin parts, the man hours are reduced compared with the conventional device employing soldering. In addition, since the metal contained in the electro-conductive resin forms electrical contacts with the terminal and since the contacts are retained in the electro-conductive resin parts, this construction curbs the influence of ambient atmosphere, thus increasing reliability.

BRIEF DESCRIPTION OF THE DRAWING FIGURES

The foregoing and further objects, features and advantages of the present invention will become apparent from the following detailed description considered with reference to the accompanying drawing figures in which like elements are designated by like reference numerals and wherein.

DETAILED DESCRIPTION OF PREFERRED EMBODIMENT

Figure 1:
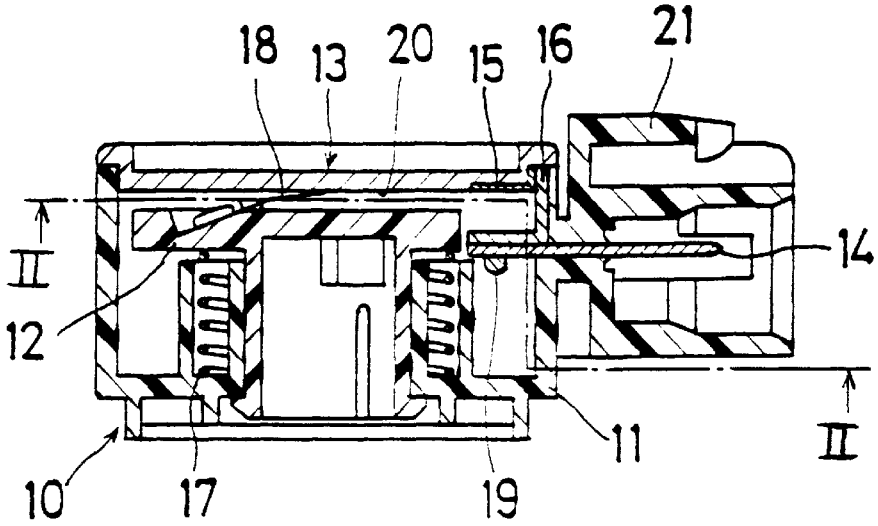
FIG. 1 is a cross-sectional view of an embodiment of the variable resistance device of the present invention.
Figure 2:
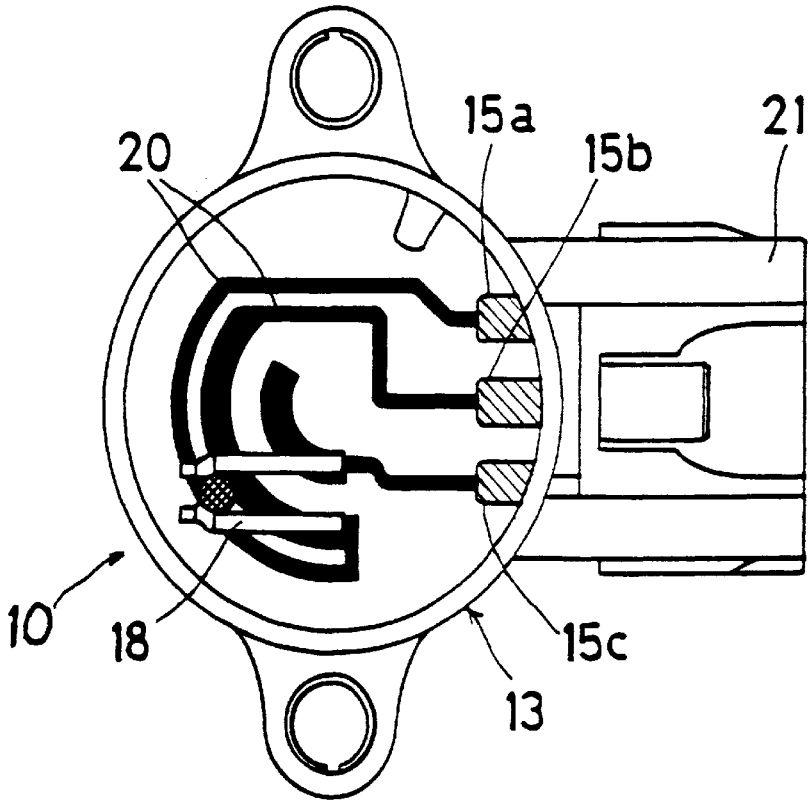
FIG. 2 is a cross-sectional view taken along the section lines II—II of FIG. 1.

Referring to FIGS. 1 and 2, the variable resistance device 10 of the present invention includes a housing 11 formed of a resin material together with a connector case 21. A substrate 13 that is formed of a thermoplastic resin by injection molding is also provided. The substrate 13 is formed integrally with a first electro-conductive resin part 15 by injection molding. The housing 11 and the connector case 21 are integrally formed in one piece. A resistor 20 is formed on the substrate 13 by screen printing, and a brush 18 slidingly contacts the resistor 20. A brush holder 12 is welded to the brush 18 and is urged upward with respect to the FIG. 1 illustration by a return spring 17. A terminal 14 made of a metal extends into the connector case 21, and a second electro-conductive resin part 16 is formed together with the terminal 14.

The electro-conductive resin from which the first and second parts 15, 16 are formed is a resin material in which metal fibers or fibers carrying metal on their surfaces are dispersed in a thermoplastic resin. Examples of the metal fibers include copper fibers, copper alloy fibers, stainless steel fibers, aluminum fibers, and nickel fibers. Examples of the electro-conductive resin include polybutylene terephthalate, polyethylene terephthalate, polyphenylene sulfide, polyamide, liquid crystal polymer, polystyrene, polyether imide, polybenzimidazole, polyether-ether ketone, polyether sulfone. According to this embodiment, the electro-conductive resin of the first and second parts 15, 16 is a dispersion of copper fibers and polybutylene terephthalate, and the copper fibers are joined by a metal that is meltable at a temperature occurring at the time of injection molding of the dispersion resin.

The composition of the electro-conductive resin is 97 vol. % of the thermoplastic resin and 3 vol. % of the copper fibers according to the embodiment. This composition makes it possible to mold the electro-conductive resin into the first and second parts 15, 16 by injection molding in substantially the same manner as in an ordinary thermoplastic resin. The volume resistivity of the first and second electro-conductive resin parts 15, 16 is about $10^{-2}$ Ω•cm according to this embodiment.

The resistor 20 is formed by screen-printing a paste containing a solvent, carbon black and a thermosetting resin as a binder, and by baking the printed paste and then letting it stand for setting. The volume resistivity of the resistor 20 is about $5\times10^3$ Ω•cm.

The volume resistivities of the resistor 20 and the first and second electro-conductive resin parts 15, 16 will be discussed below. Normally, the precision in detection of a voltage change based on the displacement of the brush 18 improves with increases in the volume resistivity of the resistor 20. However, since an excessively great magnitude of the volume resistivity of the resistor 20 will impede current through the resistor 20 to an undesired extent, the volume resistivity of the resistor 20 is preferably about $5\times10^3$ Ω•cm. Given such a preferable volume resistivity of the resistor 20, the volume resistivity of the first and second electro-conductive resin parts 15, 16 interconnecting the resistor 20 and the terminal 14 can be set to $10^{-2}$ Ω•cm without causing any problem with the performance of the variable resistance device. For this reason, the electro-conductive resin can be used as an electro-conductive material of the variable resistance device.

A method for producing a portion of the variable resistance device 10 is as follows. The second electro-conductive resin part 16 and the terminal 14 are integrated by injecting the molten electro-conductive resin into a cavity (not shown) while the terminal 14 has been set in the cavity of a mold (not shown). The molding of the second electro-conductive resin part 16 and the terminal 14 is then cooled to solidify the second electro-conductive resin part 16. By this molding process, the second electro-conductive resin part 16 is provided with a protrusion 19 for keeping the terminal 14 from falling off. The terminal 14 and the second electro-conductive resin part 16, which have been thus integrated, are then integrated with the housing 11 having the connector case 21, by injecting a molten thermoplastic resin into a cavity (not shown) after setting the terminal 14 in the cavity of a mold (not shown), and by cooling the molding of thermoplastic resin to solidify the thermoplastic resin.

Figure 3:
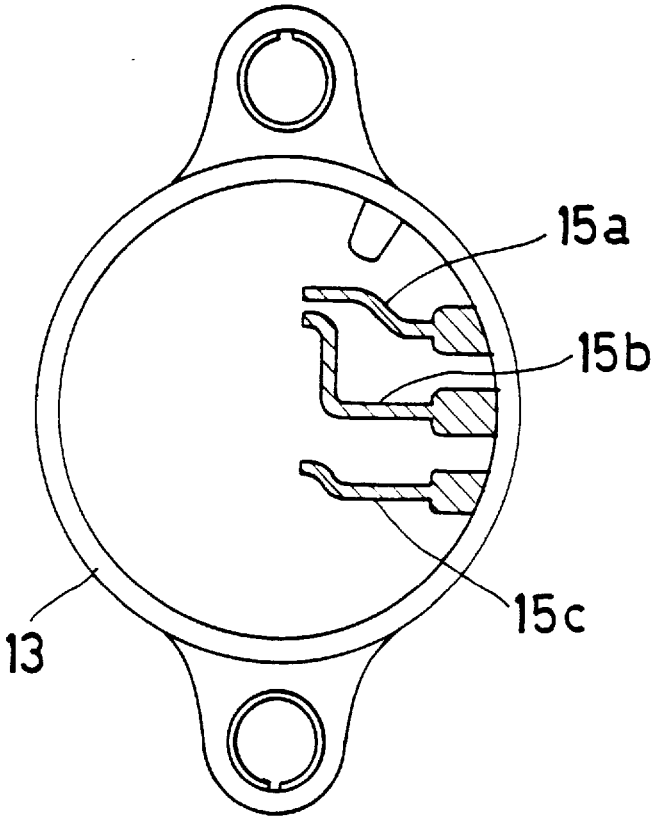
FIG. 3 is another cross-sectional view of the variable resistance device of the present invention.
Figure 4:
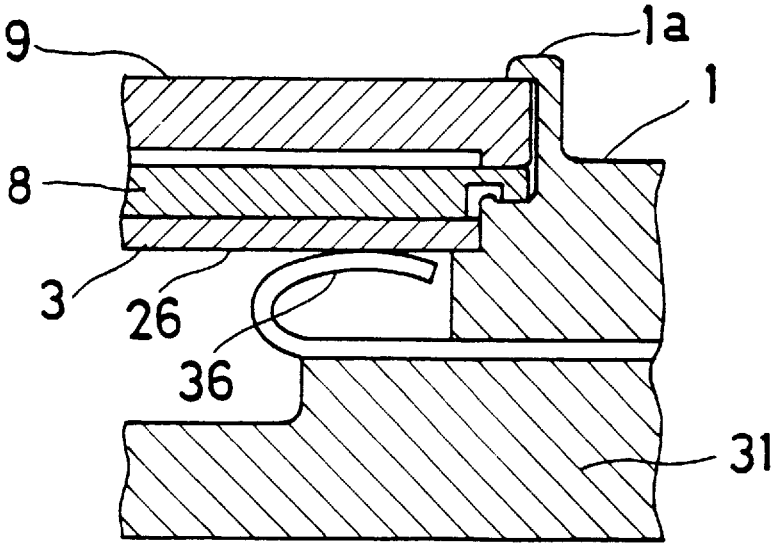
FIG. 4 is an enlarged cross-sectional view of a portion of a conventional variable resistance device.

The substrate 13 and the first electro-conductive resin part 15 are integrally formed of a thermoplastic resin, as mentioned above. FIG. 3 shows the substrate 13 in which the resistor 20 has not yet been formed. The first electro-conductive resin part 15 comprises three islands: an island 15*a* for being electrically connected to the positive terminal of a battery (not shown), an island 15*b* for being electrically connected to the negative terminal of the battery, and an island 15*c* for being connected to a voltage detecting portion (not shown). Each island becomes electrically connected to the terminal 14 via the second electro-conductive resin part 16.

After the return spring 17 is disposed in the thermoplastic resin-made housing 11, the brush holder 12 is set in the housing 11. Then, while the substrate 13 is held in contact with an end of the housing 11, the substrate 13 and the housing 11 are joined by ultrasonic bonding. The parts are designed such that as the substrate 13 contacts the end of the housing 11, the first electro-conductive resin part 15 also contacts the second electro-conductive resin part 16. Thus, the first and second electro-conductive resin parts 15, 16 are easily joined electrically by ultrasonic bonding. The resistor 20 formed on the substrate 13 is thus electrically connected to the terminal 14 by the first and second electro-conductive resin parts 15, 16.

Since the substrate 13 and the electro-conductive resin part 15 are molded together by injection, the present invention ensures sufficient electrical conduction between the terminal 14 and the resistor 20 without increasing the thickness of the substrate 13. In addition, since the copper fibers contained in the electro-conductive resin form electrical contacts with the terminal 14 and since the contacts are retained in the electro-conductive resin parts 15, 16, this construction curbs the influence of ambient atmosphere.

An apparatus employing the above-described variable resistance device 10 as a throttle sensor for detecting the opening of a throttle valve will be described. When an ignition switch (not shown) is turned on, a battery (not shown) supplies current to the terminal 14. Current flows through the second electro-conductive resin part 16, the first electro-conductive resin part 15, the resistor 20 and the brush 18, and the output voltage is detected by an output voltage detecting device (not shown).

If an accelerator pedal then becomes depressed, the throttle valve opens to a degree of opening corresponding to the depression of the accelerator pedal. If the depression of the accelerator pedal is reduced, the throttle valve correspondingly moves toward the closed position. As the throttle valve moves, the brush holder 12 correspondingly rotates or turns in an interlock fashion, turning the contact of the brush 18 over the resistor 20. As the brush 18 turns, the path length of current from the battery correspondingly changes, so that the path resistance changes and, correspondingly, tile output voltage changes. Therefore, the detection of the output voltage provides a basis for determining the throttle opening.

Although the single resistor 20 is printed on the substrate 13 and the first electro-conductive resin part 15 according to the above-described construction, a multi-layered resistor body may also be formed by, for example, forming a silver paste layer on the surface of the first electro-conductive resin part 15 and then printing two layers of a paste containing carbon black and a solvent. Such a multi-layered construction achieves substantially the same advantages as the embodiment described above.

In addition, although according to the above-described embodiment the variable resistance device is used as a throttle sensor for detecting the opening of a throttle valve, the application of the variable resistance device is not limited to a throttle sensor. The variable resistance device according to the present invention is applicable to any apparatus for detecting position or speed corresponding to a change in detected voltage.

Although the electro-conductive resin contains 97 vol. % thermoplastic resin and 3 vol. % copper fibers in the above-described embodiment, the contents of the thermoplastic resin and the metal may be set to values that enable injection molding of the electro-conductive resin, yet still increasing the degree of freedom in interconnecting the terminal and the resistor during production of the variable resistance device as compared to conventional devices.

The contents of the thermoplastic resin and the metal in the electro-conductive resin may also be set to a value equal to or greater than 80 vol. % and a value equal to or less than 20 vol. %, respectively, yet still providing sufficient conductivity for the variable resistance device and facilitating injection molding of the electro-conductive resin.

Although according to the embodiment, the volume resistivity of the resistor and the volume resistivity of the electro-conductive resin parts are $5\times10^3$ Ω•cm and $10^{-2}$ Ω•cm respectively, it is also possible to set a relationship in which the volume resistivity of the resistor is at least $10^3$ times the volume resistivity of the electro-conductive resin parts. This relationship substantially eliminates the influence of current through the electro-conductive resin member on detection of the resistance that varies as the brush moves sliding on the resistor.

In addition, the volume resistivity of the resistor may be set to a relatively high value within the range of $10^2$ to $10^4$Ω•cm while the volume resistivity of the electro-conductive resin parts is set within the range of $10^{-4}$ to 1.0 Ω•cm. With this relatively high setting of the volume resistivity of the resistor, employment of the electro-conductive resin parts has substantially no adverse effect on the position detection by the variable resistance device.

While the present invention has been described with reference to what is presently considered to be a preferred embodiment thereof, it is understood that the invention is not limited to the disclosed embodiment or construction. To the contrary, the invention is intended to cover various modifications and equivalent arrangements included within the spirit and scope of the appended claims.

What is claimed is:

1. A variable resistance device comprising:

a terminal for electrical connection to an external device;

a substrate formed of resin material;

a resistor formed in said substrate;

a gap between the terminal and the resistor;

a brush slidingly contacting the resistor; and an electro-conductive resin member made of thermoplastic resin located in said gap and electrically interconnecting the terminal and the resistor.

2. A variable resistance device according to claim 1, wherein the electro-conductive resin member is formed of a composition containing a metal in addition to the thermoplastic resin, the composition of the electro-conductive resin member permitting injection molding of the electro-conductive resin member.

3. A variable resistance device according to claim 2, wherein the electro-conductive resin member contains at least 80 vol. % of the thermoplastic resin and at most 20 vol. % of the metal.

4. A variable resistance device according to claim 1, wherein the volume resistivity of the resistor is at least $10^3$ times the volume resistivity of the electro-conductive resin member.

5. A variable resistance device according to claim 1, wherein the volume resistivity of the resistor is within a range of $10^2$ to $10^4$ Ω•cm and the volume resistivity of the electro-conductive resin member is within a range of $10^{-4}$ to 1.0 Ω•cm.

6. A variable resistance device according to claim 1, wherein the electro-conductive resin member includes a first electro-conductive resin part that is formed together with the terminal and a second electro-conductive resin part that is formed on the substrate, said first electro-conductive resin part and said second electro-conductive resin part being joined by ultrasonic bonding.

7. A variable resistance device comprising:

a housing;

a thermoplastic resin substrate mounted on the housing;

a resistor formed on the substrate;

a brush positioned in the housing in sliding contact with the resistor;

a terminal for electrical connection to an external device;

a gap between the resistor and the terminal; and an electro-conductive resin member made of thermoplastic resin extending across said gap and electrically interconnecting the terminal and the resistor.

8. A variable resistance device according to claim 7, wherein the electro-conductive resin member is formed of a composition containing a metal in addition to the thermoplastic resin.

9. A variable resistance device according to claim 8, wherein the electro-conductive resin member contains at least 80 vol. % of the thermoplastic resin and at most 20 vol. % of the metal.

10. A variable resistance device according to claim 7, wherein the volume resistivity of the resistor is at least $10^3$ times the volume resistivity of the electro-conductive resin member.

11. A variable resistance device according to claim 7, wherein the volume resistivity of the resistor is within a range of $10^2$ to $10^4$ Ω•cm and the volume resistivity of the electro-conductive resin member is within a range of $10^{-4}$ to 1.0 Ω•cm.

12. A variable resistance device according to claim 7, wherein the electro-conductive resin member includes a first electro-conductive resin part that is formed together with the terminal and a second electro-conductive resin part that is formed on the substrate, said first electro-conductive resin part and said second electro-conductive resin part being joined by ultrasonic bonding.

13. A variable resistance device according to claim 7, including a connector case integrally formed in one piece with the housing, said terminal extending into the connector case.

14. A variable resistance device according to claim 7, including a brush holder connected to the brush.

* * * * *